US010661128B2

(12) United States Patent
Ripp

(10) Patent No.: US 10,661,128 B2
(45) Date of Patent: May 26, 2020

(54) ADJUSTABLE CLUB HEAD

(71) Applicant: Dunlop Sports Company Limited, Kobe (JP)

(72) Inventor: Patrick Ripp, Seal Beach, CA (US)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 14/876,731

(22) Filed: Oct. 6, 2015

(65) Prior Publication Data

US 2017/0095707 A1 Apr. 6, 2017

(51) Int. Cl.
*A63B 53/04* (2015.01)

(52) U.S. Cl.
CPC .... *A63B 53/047* (2013.01); *A63B 2053/0433* (2013.01); *A63B 2053/0491* (2013.01)

(58) Field of Classification Search
CPC ..... A63B 53/047; A63B 53/00; A63B 53/005; A63B 53/04; A63B 53/06; A63B 53/0475; A63B 53/0466; A63B 2053/0433; A63B 2053/0491; A63B 2053/0408; A63B 2053/0479; A63B 2053/0483
See application file for complete search history.

(56) References Cited

U.S. PATENT DOCUMENTS 2,332,342 A 10/1943 Reach
3,220,733 A 11/1965 Saleeby
4,708,347 A 11/1987 Kobayashi
5,439,223 A * 8/1995 Kobayashi ..... A63B 53/04 473/334
5,776,010 A * 7/1998 Helmstetter ..... A63B 53/04 473/334
5,807,186 A 9/1998 Chen
5,833,551 A * 11/1998 Vincent ..... A63B 53/04 473/349
5,938,540 A * 8/1999 Lu ..... A63B 53/04 473/288
6,569,029 B1 * 5/2003 Hamburger ..... A63B 53/047 473/238
6,929,563 B2 * 8/2005 Nishitani ..... A63B 53/047 473/334
7,789,771 B2 9/2010 Park et al.
8,083,607 B2 12/2011 Clausen et al.
(Continued)

OTHER PUBLICATIONS

US 8,777,770 B2, 07/2014, Yashiki (withdrawn)

*Primary Examiner* — John E Simms, Jr.
(74) *Attorney, Agent, or Firm* — Stetina Brunda Garred and Brucker; Mark B. Garred

(57) ABSTRACT

An iron-type golf club head assembly kit including a club head main body, a first sole component, and a second sole component interchangeably associable with the main body. When the first sole component is associated with the main body, the main body and the first sole component form a first club head comprising a sole surface having a first parting line, formed between the first sole component and the main body, and a first sole contour. When the second sole component is associated with the main body, the main body and the second sole component form a second club head comprising a second sole surface having a second parting line, formed between the second sole component and the main body, and a second sole contour that differs from the first sole contour.

8 Claims, 6 Drawing Sheets

(56) References Cited

U.S. PATENT DOCUMENTS

| | | | | |
|---|---|---|---|---|
| 8,133,128 | B2 | 3/2012 | Boyd et al. | |
| 8,216,088 | B2 | 7/2012 | Hatton et al. | |
| 8,257,198 | B2 | 9/2012 | Gilbert et al. | |
| 8,376,878 | B2 | 2/2013 | Bennett et al. | |
| 8,409,031 | B2 | 4/2013 | Stites et al. | |
| 8,491,405 | B2 | 7/2013 | Jorgensen et al. | |
| 8,517,855 | B2 | 8/2013 | Beach et al. | |
| 8,545,343 | B2 | 10/2013 | Boyd et al. | |
| 8,550,933 | B2 | 10/2013 | Demkowski et al. | |
| 8,574,094 | B2 | 11/2013 | Nicolette et al. | |
| 8,616,991 | B2 | 12/2013 | Billings | |
| 8,632,420 | B2 | 1/2014 | Kawaguchi et al. | |
| 8,636,606 | B2 | 1/2014 | Sato | |
| 8,668,598 | B2 | 3/2014 | Gilbert et al. | |
| 8,690,707 | B2 | 4/2014 | Stites et al. | |
| 8,690,708 | B1 | 4/2014 | Ehlers | |
| 8,696,491 | B1 | 4/2014 | Myers | |
| 8,715,105 | B2 | 5/2014 | Stites et al. | |
| 8,721,472 | B2 | 5/2014 | Kuan et al. | |
| 8,740,722 | B2 | 6/2014 | Sato | |
| 8,747,252 | B2 | 6/2014 | Lukasiewicz, Jr. et al. | |
| 8,747,253 | B2 | 6/2014 | Stites | |
| 8,753,225 | B1 | 6/2014 | Abbott et al. | |
| 8,753,226 | B2 | 6/2014 | Rice et al. | |
| 8,758,154 | B2 | 6/2014 | Demkowski et al. | |
| 8,758,163 | B2 | 6/2014 | Stites | |
| 8,777,774 | B1 | 7/2014 | Kim et al. | |
| 8,821,307 | B2 | 9/2014 | Park et al. | |
| 8,840,485 | B2 | 9/2014 | Jorgensen et al. | |
| 8,876,624 | B2 | 11/2014 | Ban et al. | |
| 2006/0172822 | A1* | 8/2006 | Liang | A63B 53/0466 473/350 |
| 2011/0256953 | A1* | 10/2011 | Jorgensen | A63B 53/047 473/324 |
| 2012/0064996 | A1* | 3/2012 | Gilbert | A63B 53/047 473/349 |
| 2012/0064997 | A1* | 3/2012 | Sato | A63B 53/047 473/350 |
| 2012/0238375 | A1* | 9/2012 | Park | A63B 53/04 473/331 |
| 2015/0005099 | A1* | 1/2015 | Hettinger | A63B 53/047 473/350 |
| 2015/0231457 | A1* | 8/2015 | Sander | A63B 53/06 473/244 |

* cited by examiner

ADJUSTABLE CLUB HEAD

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to a golf club head, and more specifically, to a golf club head having a main body adapted to be selectively attached to one of a plurality of sole components to achieve desired performance characteristics.

2. Description of the Related Art

It is well known that the physical properties of a golf club have a significant impact on how the club "feels" during use. One particular term commonly used in the golf industry in reference to the way a club performs or feels during use is the "effective bounce" of the golf club. The effective bounce of a golf club is typically not dictated by a single physical characteristic of the golf club. Rather, the effective bounce relates to several club head factors, such as the sole length, sole width, "take-off angle" (as described in further detail below), etc. A golfer's preferred effective bounce may be dictated by the golfer's particular swing characteristics, as well as the playing conditions of the golf course. For instance, low bounce wedges may be preferred for shots off tight lies and in bunkers with very little or very firm sand, as well as for golfers with very steep swings. High bounce wedges may be preferred from the rough, soft lies, bunkers with lots of sand or very soft sand, as well as for golfers with generally flat swings.

In view of the variability associated with effective bounce, golf club manufacturers have designed various club heads having different bounce characteristics. Bounce variability in club heads is particularly prevalent in relation to the design of wedge-type golf clubs. Along these lines, many currently commercially available wedges of a prescribed loft are provided in separate low, medium and high bounce models, the design of any particular wedge being limited to a prescribed effective bounce. Thus, if a golfer wants, for example, to take advantage of high bounce and low bounce wedges to accommodate e.g. differing course conditions, typically several different wedges of the same loft much be purchased since, as indicated above, current conventional wedge designs do not accommodate any bounce variability. Furthermore, players desiring to be fit for proper club head sole characteristics, e.g. bounce angle, are typically inconvenienced by a lack of test clubs have simple back and forth sole adjustment to accommodate such fitting.

Accordingly, there is a need for a club head, and more particularly a wedge, which provides adaptability in the effective bounce associated with the club head. Various aspects of the present disclosure address this particular need, as will be discussed in more detail below.

BRIEF SUMMARY

In accordance with one embodiment of the present disclosure, there is provided an iron-type (and more particularly a wedge-type) golf club head assembly kit including a main body, a first sole component and a second sole component interchangeably associable with the main body. The main body includes a striking face having a face center, a leading edge, a virtual striking face plane. The main body also has a rear surface opposite the striking face, and a hosel defining a hosel axis. When the first sole component is associated with the main body, the main body and the first sole component collectively form a first club head comprising a sole surface having a first parting line formed between the first sole component and the main body, and a first sole contour. When the first club head is oriented in a reference position, in a virtual central vertical plane passing through the face center and perpendicular to the striking face plane, in a direction perpendicular to the virtual striking face plane, the parting line is spaced rearwardly from the striking face by a distance D1 and the club head has a maximum depth D2 such that D1/D2 is no less than 0.40. When the second sole component is associated with the main body, the main body and the second sole component collectively form a second club head comprising a second sole surface having a second parting line, formed between the second sole component and the main body, and a second sole contour that differs from the first sole contour.

The golf club head assembly kit may further include a screw member having a screw head and a screw shaft that defines a screw shaft axis. The screw member may be configured to secure one of the first or second sole components to the main body to form a corresponding one of the first and second club heads such that when either of the first and second club heads is oriented in the reference position, the screw shaft axis intersects a virtual vertical hosel plane that contains the hosel axis at a screw shaft angle of between about 75° and about 110°.

When the golf club head assembly is configured as first club head, and such first club head is oriented in the reference position, in the virtual central vertical plane, and measured in the direction perpendicular to the virtual striking face plane: (a) the first sole component may further comprise a forward-most point defining a sole component forward plane parallel to the striking face plane and a rearward-most point defining a sole component rearward plane parallel to the striking face plane; (b) a plane passing through the first parting line and parallel to the striking face plane may be rearwardly spaced from the sole component forward plane by a distance D3; and (c) the sole component rearward plane may be rearwardly spaced from the sole component forward plane by a distance D4 such that D3/D4 is no less than 0.30.

When the first club head is oriented in the reference position, in the virtual central vertical plane, the parting line may be rearwardly spaced from the leading edge by a horizontal distance of no less than 0.35 in.

The first club head may further comprise a loft angle no less than 38°.

When respectively oriented in the reference position, the first club head may include a first leading edge height and the second club head may include a second leading edge height that differs from the first leading edge height by at least 0.15 mm.

According to another aspect of the disclosure, there is provided an iron-type golf club head, such as a wedge-type golf club head that, when oriented in a reference position, comprises a main body and a sole component removably secured to the main body. The main body includes a striking face having a face center, a leading edge, a virtual striking face plane. The main body also includes a rear surface opposite the striking face, and a hosel defining a hosel axis. A sole surface is collectively formed by the main body and the sole component, with the sole surface having a sole contour, and a first parting line formed between the sole component and the main body. In a virtual central vertical plane passing through the face center and perpendicular to the virtual striking face plane, measured in a direction perpendicular to the striking face, the parting line is spaced rearward from the striking face by a distance D1 and the club head has a maximum depth D2 such that D1/D2 is no less than 0.50.

It is contemplated that D1/D2 may be no less than 0.70.

The golf club head may further comprise a virtual vertical hosel plane that includes the hosel axis, and a fastener configured to secure the sole component to the main body.

In yet another implementation of the present disclosure, there is provided an iron-type golf club head, such as a wedge-type golf club head that, when oriented in a reference position, comprises a main body and a sole component removably secured to the main body. The main body includes a striking face having a face center, a leading edge, a virtual striking face plane. The main body also includes a rear surface opposite the striking face, and a hosel defining a hosel axis. A sole surface is collectively formed by the main body and the sole component, with the sole surface having a sole contour and a first parting line formed between the first sole component and the main body. In a virtual central vertical plane passing through the face center and perpendicular to the virtual striking face plane, the parting line is spaced rearwardly from the striking face by a horizontal distance D5 that is no less than 0.35 in.

D5 may be between about 0.40 in and 0.70 in.

In the virtual central vertical plane, the sole surface may further comprise a sole surface horizontal length D6 such that D5/D6 is no less than 0.50. D5/D6 may also be no less than 0.60.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
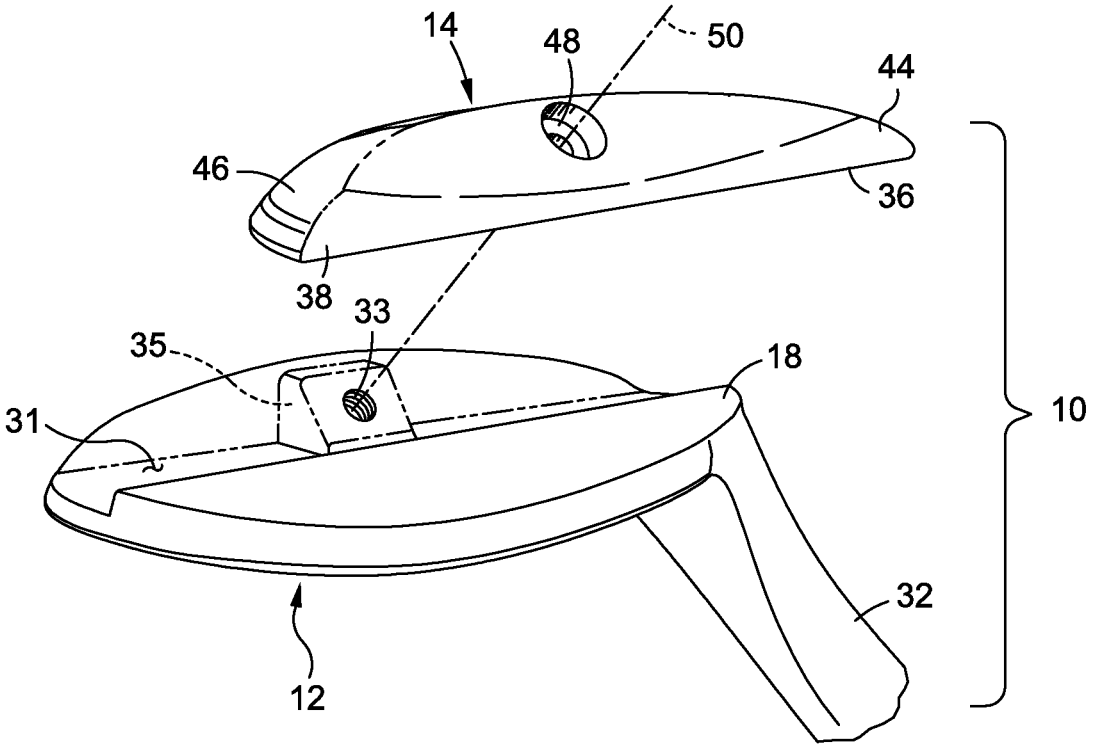
FIG. 1 is a rear exploded perspective view of an iron-type or wedge type golf club head having a detachable sole component exploded from a main body.
Figure 2:
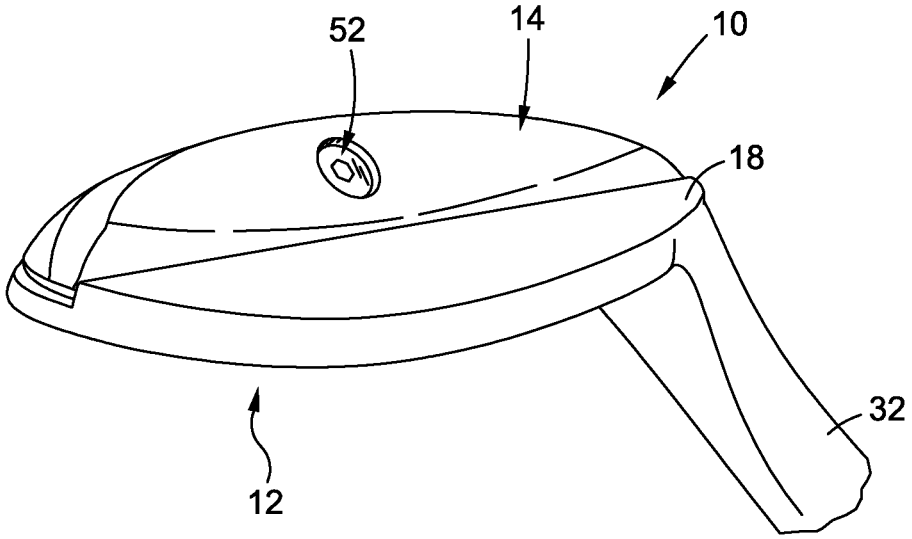
FIG. 2 is an assembled rear perspective view of the golf club head shown in FIG. 1.
Figure 3:
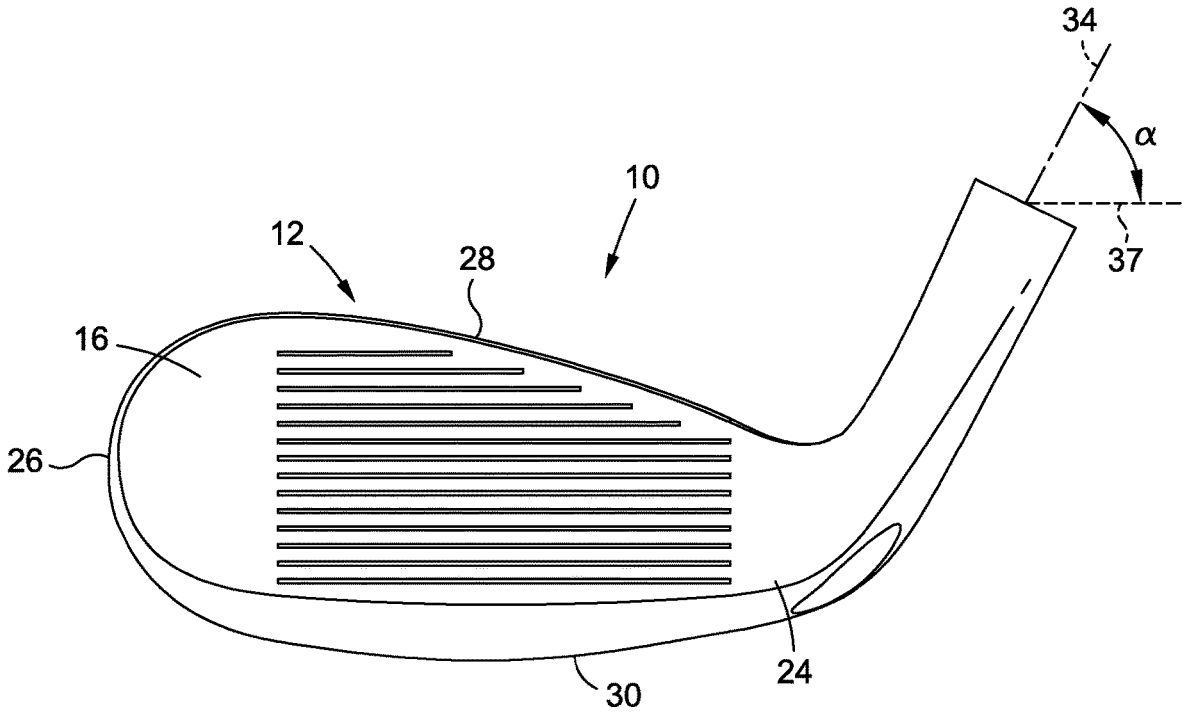
FIG. 3 is a front view of the golf club head shown in FIG. 2.

The detailed description set forth below in connection with the appended drawings is intended as a description of certain embodiments of an adjustable sole iron-type golf club head, and in particular an adjustable sole wedge-type golf club head, and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. For example, while the present disclosure find particularly utility in relation to wedge type golf clubs, the structural and functional features described below may be applied to other iron-type golf club heads as well. It is further understood that the use of relational terms such as first and second, and the like are used solely to distinguish one entity from another without necessarily requiring or implying any actual such relationship or order between such entities. All recitations of parameter values as "approximate" values are intended to serve as implicit recitations of the precise values of such parameters as optional characteristics of the one or more embodiments to which they pertain.

Referring to FIGS. 1-4 and according to one embodiment, there is depicted a golf club head 10 having a main body 12 adapted to be interchangeably attachable to one of a plurality of different sole components to attain a preferred "feel" for the player using the club head 10 based e.g. on a prescribed alteration in the "bounce" of the club head. In particular, the different sole components each define different structural characteristics, such that each sole component provides a different bounce relative to the other sole components when attached to the main body 12. As described above, "bounce" as used herein denotes "effective bounce," which, as described above, may not connote a specific single measurable aspect of a sole, but rather generally pertains to aspects of a golf club sole surface that may contribute to the way the club head feels based on interaction with turf and the way the club may sit when resting on turf in a static position. Classifications of bounce may, in some cases, be based on a single factor, e.g. take-off angle (as described below). However, for practical purposes, "effective bounce" classification conventionally accounts for a number of sole surface aspects that may or may not include take-off angle, sole width, front-to-rear sole camber, and heel-to-toe sole camber. Preferably classifications of effective bounce (and in turn distinctions in one or more interchangeable sole portions having different "bounce" characteristics) include at least differences in "take-off angle" and/or sole width. The user may select a particular sole component based on the user's swing characteristics, playing environment, or other factors.

The golf club head 10 is an iron-type golf club head, and more particularly a wedge, with the main body 12 including a striking face 16 and a rear surface 18 in opposed relation to the striking face 16. The club head 10 preferably defines a blade portion being an upper portion and (via combination of the main body 12 and the sole component 14) a lower muscle portion associated with the blade portion. The blade portion preferably defines a striking wall thickness, "T," between the striking and rear faces 16, 18. According to various embodiments, the striking wall thickness T is preferably equal to approximately 0.15-0.50 inches, more preferably equal to 0.20-0.30 inches, and most preferably equal to approximately 0.22 inches. The striking face 16 includes a face center 20 and a leading edge 21, and defines a striking face plane 22, with the striking face 16 being adapted to repeatedly strike a golf ball during the lifespan of the club head 10. In this respect, the striking face 16 may include a plurality of grooves to impart spin to the golf ball on impact and/or to displace water or grass from the face 16 to allow for more direct impact between the club head 10 and the golf ball. The main body 12 further includes a heel 24, a toe 26, a top line 28, and an opposing sole 30. A recess 31 (see e.g. FIG. 1) extends into the main body 12 from the rear surface 18 adjacent the sole 30, and is adapted to at least partially receive the sole component 14, as will be described in more detail below. The main body 12 further includes a bore 33 extending into the main body 12 for attaching the sole component 14 to the main body 12. The bore 33 may be formed within a boss 35 which protrudes from the recess 31 in rearward direction. The main body 12 is fabricated from a metallic material, by forging, casting, or through other manufacturing techniques known in the art. A hosel 32 is coupled to the main body 12, extending from the heel 24 and defining a hosel axis 34. The hosel 32 is adapted to engage with a club shaft. The golf club head 10 is said to be in a "reference position" relative to a virtual ground plane, e.g. ground plane 37, when the hosel axis 34 is coplanar with an imaginary vertical hosel plane 35 that is perpendicular a virtual plane 22 that is perpendicular to the general plane of the striking face 16 and the scorelines extend generally parallel to the ground plane 37 Unless otherwise indicated, all parameters herein are specified with the golf club head 10 in the reference position.

Figure 4:
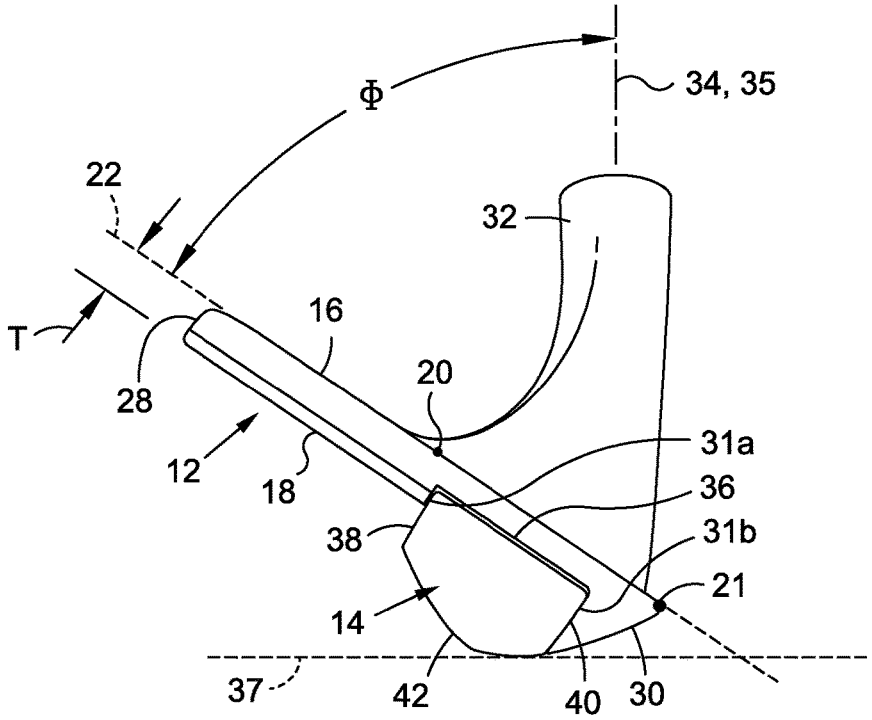
FIG. 4 is a toe side view of the golf club head shown in FIGS. 2 and 3 with the sole component being attached to the main body.

The main body 12 defines a loft angle, Φ, as the angle between the hosel plane 35 and the striking face plane 22, as shown in FIG. 4. According to various embodiments, the loft angle Φ is preferably no less than 38°, even more preferably greater than 40°, still more preferably between 45° and 70°, and even more preferably between 55° and 60° and most preferably equal to approximately 56°. Golf club heads, e.g. iron-type club heads, of lofts within these ranges are particularly apt for sole contour adjustment provided an increased tendency to "dig" into the ground.

As noted above, the main body 12 is specifically adapted for interchangeable use with a plurality of differently configured sole components 14, particular examples of which will be described in more detail below with reference to FIGS. 12-14. In this respect, the golfer may select which one of the plurality of sole components 14 to attach to the main body 12 to define the golf club head 10, with each sole component 14 providing unique bounce and hence "feel" attributes when attached to the main body 12. For instance, the different sole components 14 may have different dimensions and define different contours, which may create a distinctive feel of the club head 10. It is also contemplated that the sole components 14 may have different weights, densities, materials or other structural distinctions aimed at creating distinctive attributes to the club head 10, and notably the bounce characteristic described above.

In general, each sole component 14 includes an inner surface 36, a top surface 38, a bottom surface 40, and a rear surface 42, with the sole component 14 defining a heel portion and a toe portion. A counter-bore 48 is formed through the sole component 14 and defines a counter-bore axis 50, which passes through the rear surface 42 and the inner surface 36.

According to one embodiment, the sole component 14 may be attached to the main body 12 by positioning the sole component 14 within the recess 31, with the inner surface 36 of the sole component 14 facing the main body 12. The boss 35 may assist in properly locating the sole component 14 relative to the main body 12, such that the counter-bore 48 is coaxially aligned with the bore 33 formed on the main body 12. A mechanical fastener, such as a screw 52, may be used to secure the sole component 14 to the main body 12. The sole component 14 and main body 12 are preferably configured such that the sole component 14 abuts both an inner surface 36 of the recess 31, a recess upper sidewall 31*a* and a recess lower sidewall 31*b*. By configuring the sole component 14 to abut these respective recess sidewalls 31*a* and 31*b*, the sole component 14 and main body 12 combination may be more likely to behave as a solid component upon an impact of the club head 10 with a golf ball during typical play. For example, slight movement (which may result in clicking) of the sole component may be further minimized due to the abutment of plural surfaces that are angled relative to each other (as opposed to abutment generally about a surface in a single plane). In this regard, feel is improved, enabling such an adjustable club head to be more likely accepted as a replacement for a similar non-adjustable type club head (which may likely actually be formed of a single unitary component). As a corollary, by providing a more solid feel, such an adjustable club head, if used as a fitting tool, is more likely to feel like a conventional purchasable non-adjustable club head to which such adjustable club head may have been intended to correspond. In this case, a golfer undergoing a bounce fitting is less likely to be disappointed that an actual purchased club does not feel like a test club intended to represent the purchased club (or at a minimum feel that the fitting operation was of little value). In some embodiments, at least one of (and in some cases both of) the sidewalls 31*a* and 31*b* of the recess 31 is tapered in complementary manner to a tapered portion of the upper surface 38 and lower surface 40 of the sole component 14. In this manner, the association between the main body 12 and the sole component 14 may be made more snug and/or accommodate manufacturing tolerances. By solidly securing the sole portion 14 to the main body 12, generating relatively thin regions in the sole component 12 (e.g. to blend into the blade portion of the club head) may be avoided. Such thin portions may be associated with propagating unwanted vibrations upon impact of the striking face 16 with a golf ball in typical use.

Figure 5:
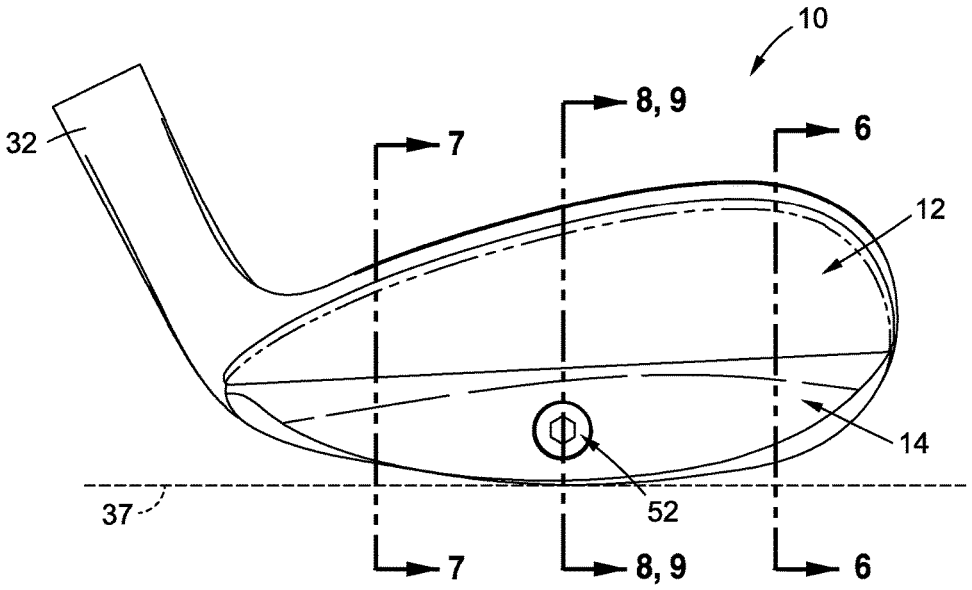
FIG. 5 is a rear view of the golf club head shown in FIGS. 2-4 with the sole component being attached to the main body.
Figure 6:
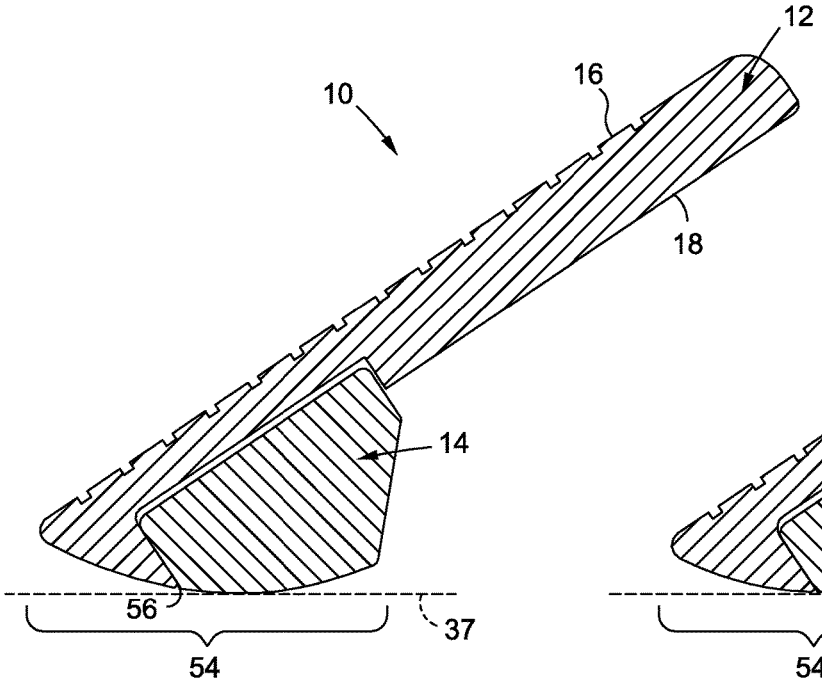
FIG. 6 is a side sectional view of the golf club head taken along line 6-6 as shown in FIG. 5.
Figure 7:
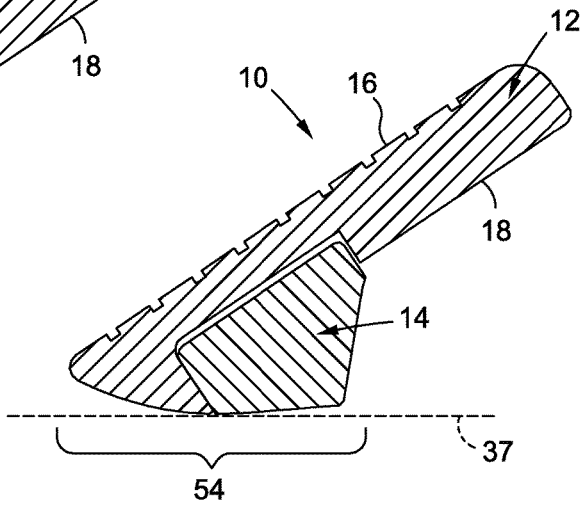
FIG. 7 is a side sectional view of the golf club head taken along line 7-7 as shown in FIG. 5.

Referring now to FIG. 5, there is depicted a rear view of the club head 10 having one prescribed sole component 14 attached to main body 12. FIG. 6 is a side sectional view of the club head 10 shown in a transverse plane located adjacent the toe of the club head 10, while FIG. 7 is a side sectional view of the club head 10 shown in the transverse plane located adjacent the heel of the club head 10. As is apparent, the size of the sole component 14 may vary in a heel to toe direction, with the sole component 14 having a larger cross sectional area proximate the heel than proximate the toe (and distal the heel).

The sole component 14 and main body 12, when attached to each other, collectively define a sole surface 54 having a sole contour including a parting line 56 at the intersection of the main body 12 and sole component 14. In view of the sole component 14 defining a portion of the sole surface 54, the contour of the sole surface 54 may be varied by interchanging one sole component 14 for another. Along these lines, a set of at least three sole components 14*a*, 14*b* and 14*c* are shown in FIGS. 12-14. The at least three sole components 14*a*, 14*b*, and 14*c* are interchangeably attachable to a main body 12 to vary contour of the sole surface formed between the main body 12 and the sole component (of the set of sole component 14*a*, 14*b*, and 14*b*) that is secured to the main body 12. When, for example, the first sole component 14*a* (FIG. 12) is attached to the main body 12, the first sole component 14*a* and main body 12 collectively form a first club head 10*a* including a first sole surface defining a first sole contour having a first parting line formed between the first sole component 14*a* and the main body 12. If the first sole component 14*a* is removed and replaced with, for example a second sole component 14*b* (FIG. 13), the main body 12 and the second sole component 14*b* collectively form a second club head 10*b*, which differs from the first club head 10*a*, and includes a second sole surface defining a second sole contour having a second parting line formed between the second sole component and the main body 12.

Figure 8:
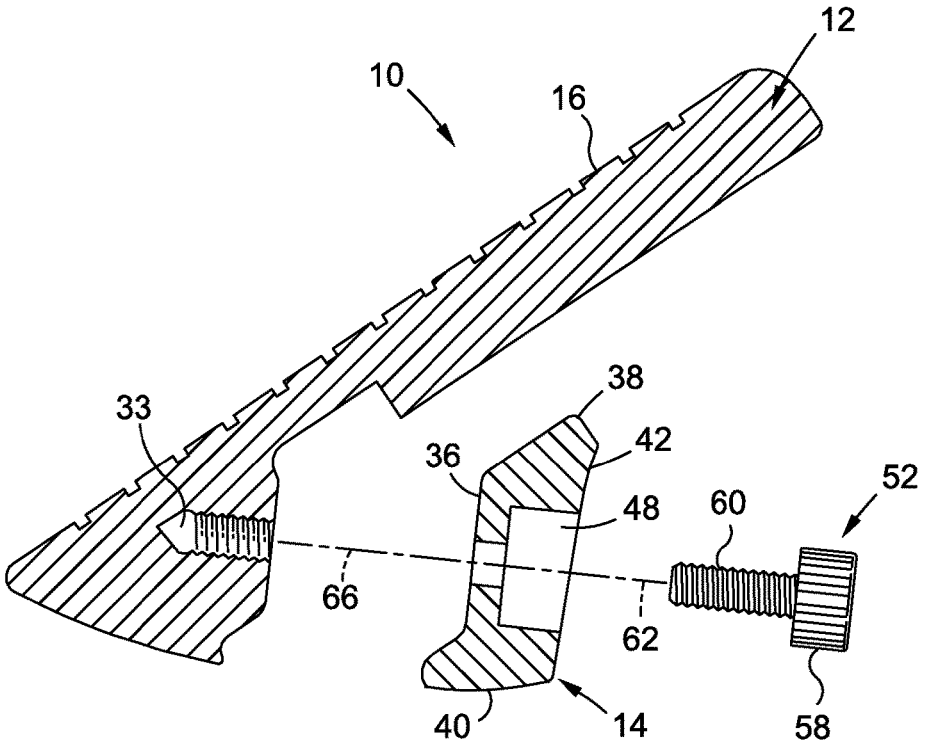
FIG. 8 is an exploded side sectional view of the golf club head taken along line 8-8 as shown in FIG. 5.
Figure 9:
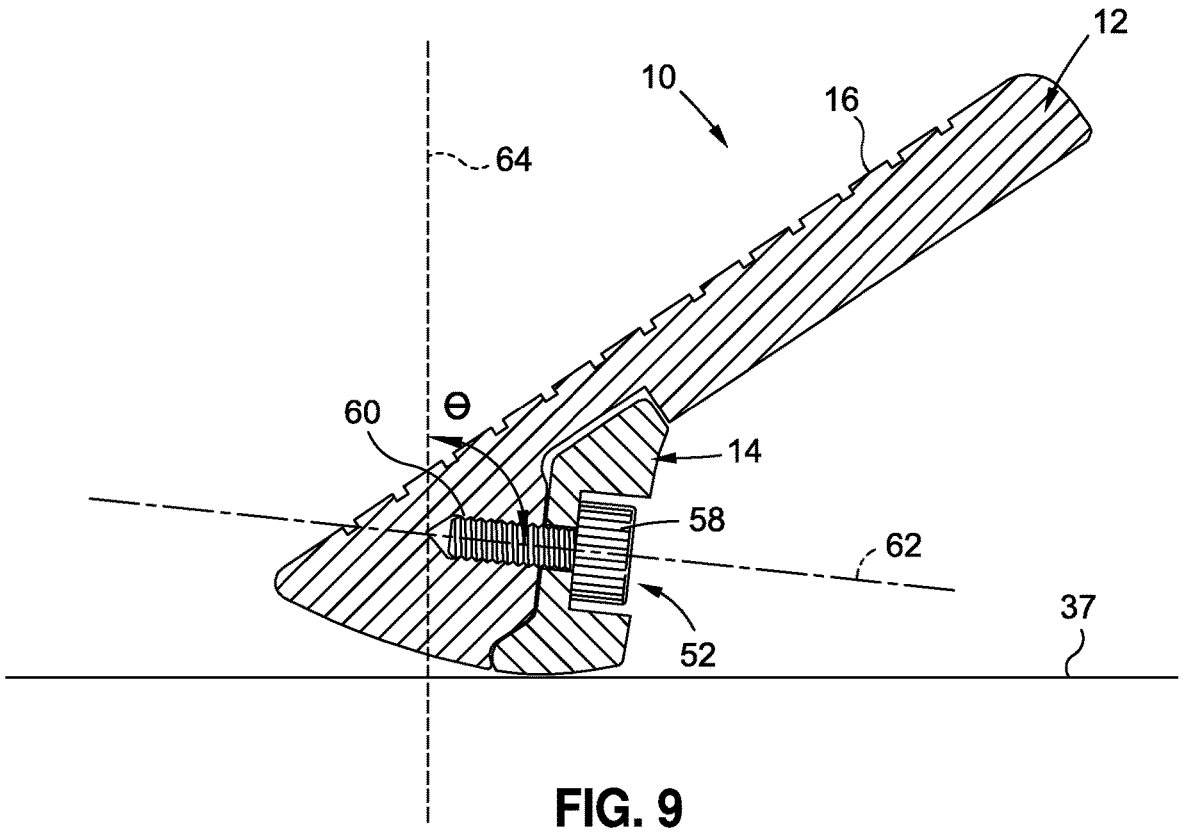
FIGS. 9-11 are assembled side sectional views of the golf club head taken along line 9-9 as shown in FIG. 5, each highlighting different parameters of the club head.

Referring now specifically to FIGS. 8 and 9, there is depicted cross sectional views of the club head 10 taken within a cross sectional vertical plane which passes through the face center 20 and is perpendicular to the striking face plane 22, with FIG. 8 depicting an exploded view and FIG. 9 depicting an assembled view. As can be seen, the sole component 14 is attached to the main body 12 via the screw member 52 having a screw head 58 and an externally threaded screw shaft 60 that defines a screw shaft axis 62. According to one embodiment, there are preferably no less than three threads on the screw shaft 60, and more preferably from 3-5 threads on the screw shaft 60. Of course, other embodiments may include more than 5 threads on the screw shaft 60 without departing from the spirit and scope of the present disclosure.

The screw member 52 is configured to secure the sole component 14 to the main body 12 to form the club head 10 such that, when the club head 10 is oriented in the reference position, the screw shaft axis 62 intersects a virtual vertical hosel plane 64 that contains the hosel axis at a screw shaft angle, Θ, of between about 75° and about 110°, more preferably between 80°-100°, and more preferably equal to about 90°. Along these lines, the bore 33 is internally threaded and configured to engage with the external threads on the screw shaft 60, with the bore 33 being disposed about a bore axis 66, which is equal to the screw shaft angle Θ. The bore 33 extends into the main body 12 deep enough to allow for a sufficient number of thread turns. The counter-bore 48 formed in the sole component 14 includes a first section that is of a first diameter larger than the diameter of the screw shaft 60 and smaller than the diameter of the screw head 58, and a second section that is of a second diameter larger than the diameter of the screw head 58, such that when the screw is completely advanced into the bore 33, the screw head 58 is received within the second section of the counter-bore 48, as shown in FIG. 9. According to one embodiment, the screw head 58 is a socket-style screw head, which matches the tool socket for adjustable/removable shaft securing screws, although it is understood that the screw head 58 may be a Phillips-head-style screw head, flat-head-style screw head, or a socket adapted to operably engage with a wrench, allen wrench, allen key, torx wrench, a wrench having a polygonal cross-section, a wrench having a proprietary cross-sectional shape, or other types of screw heads known in the art. In some embodiments a set of sole components may be offered in combination with the main 12 and/or a corresponding fastening tool to appropriately secure any of the sole components 14*a*, 14*b*, and 14*c* to the main body 12. Such a tool may comprise a conventional screw driver, wrench, allen wrench, allen key, torx wrench, a wrench having a polygonal cross-section, a wrench having a proprietary cross-sectional shape, or the like. In one or more embodiments, the fastening tool includes a torque-sensing device and, optionally, an indicator for indicating, to the user, the current torque being applied to the fastener and/or when a threshold torque has been reached or exceeded. Furthermore, the main body 12 and sole component 14 are adapted to enable to the sole component 14 to be attached to the main body 12 via a single screw member 52, which provides simplicity and ease of use, and allows for quick and easy interchangeability of the sole component 14 to the main body 12. The configuration of the bore 33, counter-bore 48 and the screw member 52 may also reduce "clicking" during use by virtue of plural points of contact therebetween. This configuration, particularly the case in which the screw bore 33 extends from the rear surface of the sole component 14 at an angle within the ranges of angles described above, ensures that the screw enters the main body 12 in a location and in a direction aligned with a relative thick portion of the club head 12. This allows diminished presence of thin walls and/or unnecessary "hollowing" of the main body 12, which may promote beneficial feel. Also, orienting the screw bore 33 in this manner ensures that a relative lengthy portion of screw material is secured to the main body 12, further enabling a solid association of the sole component 14 and the main body 12, promoting beneficial feel and ensuring the structural integrity of the multi-component club head system.

It is also contemplated that an optional tape layer or other adhesives may be used in addition to the screw member 52 to couple the sole component 14 to the main body 12. The tape layer may improve the feel and further reduce "clicking," although in most instances, the use of the screw member 52 without an additional tape layer may be considered sufficient.

According to another embodiment, a captive screw may be used to secure the sole component 14 to the main body 12. The use of a captive screw may permit unthreading to remove the sole component 14 while keeping the screw retained in the main body 12.

It is further contemplated that the sole component 14 and main body 12 may be coupled using any fastening element or technique known in the art. For instance, the sole component 14 may be coupled to the main body 12 using one or more magnets, or a screw having a spring to enable quick release or quick-turn options in reducing the time associated with interchanging sole components.

Figure 10:
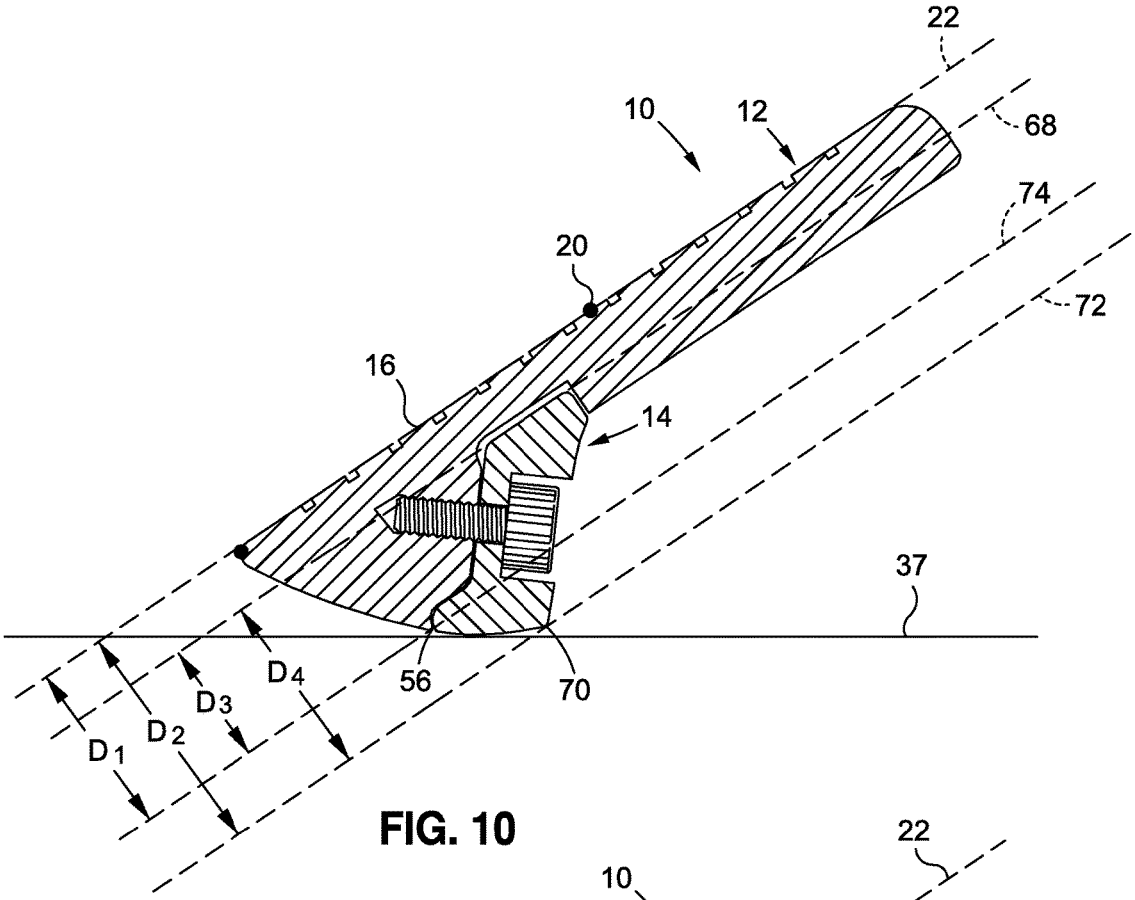
Figure 11:
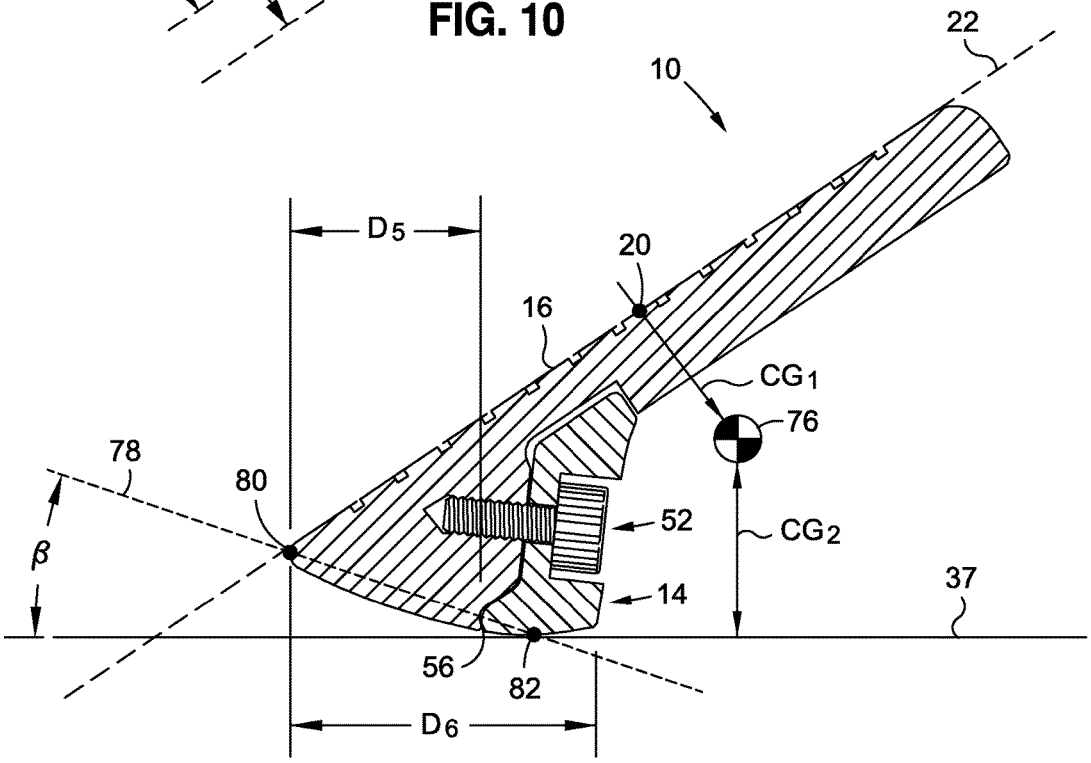

FIGS. 10 and 11 are reproductions of the club head 10 shown in FIG. 9, for purposes of illustrating various dimensions and parameters associated with the club head 10. With reference specifically to FIG. 10, the sole component 14 includes a forward-most point defining a sole component forward plane 68 parallel to the striking face plane 22 and a rearward-most point 70 defining a sole component rearward plane 72 parallel to the striking face plane 22. The club head 10 further includes a plane 74 passing through the parting line 56 and parallel to the striking face plane 22. The distance between the striking face plane 22 and the plane 74 passing through the parting line 56 defines a distance D1. The distance between the striking face plane 22 and the sole component rearward plane 72 defines a distance D2, and a maximum depth. The distance between the sole component forward plane 68 and the plane passing through the parting line 56 defines a distance D3. The distance between the sole component forward plane 68 and the sole component rearward plane 72 defines a distance D4.

According to one embodiment, the distance D1 is preferably greater than or equal to approximately 0.25 inches, and more preferably greater than or equal to approximately 0.35 inches, even more preferably between approximately 0.40 inches and 0.60 inches, still even more preferably between approximately 0.42 inches and 0.50 inches, and most preferably equal to approximately 0.47 inches.

According to another embodiment, the distance D2 is preferably greater than or equal to approximately 0.50 inches, more preferably between approximately 0.60 inches and 0.75 inches, and most preferably equal to approximately 0.63 inches.

According to still another embodiment, the distance D3 is preferably greater than or equal to approximately 0.25 inches, more preferably between approximately 0.30 inches and 0.40 inches, and most preferably equal to approximately 0.35.

According to yet another embodiment, the distance D4 is preferably greater than approximately 0.35 inches, more preferably between approximately 0.45 inches and 0.60 inches, and most preferably equal to approximately 0.51 inches.

In addition to the foregoing dimensions, there are several preferred ratios associated with the club head 10. According to one embodiment, the ratio of D1/D2 is preferably greater than or equal to approximately 0.40, more preferably greater than or equal to approximately 0.50, even more preferably greater than or equal to approximately 0.70, and most preferably equal to approximately 0.74. The ratio of D3/D4 is preferably greater than or equal to approximately 0.30, more preferably greater than or equal to approximately 0.50, even more preferably greater than or equal to 0.60, yet more preferably greater than or equal to approximately 0.65, and most preferably equal to approximately 0.68. By configuring the adjustable club head 10 in this regard, the parting line proximate the sole surface 54 is relatively rearward with respective to the club head 10. This minimizes the possibly-detrimental effect of the parting line on feel as it is located at or near a point of primary turf interaction. Accordingly, the above described configurations enable such an adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

Referring now to FIG. 11, the club head 10 formed by the combined main body 12 and sole component 14 defines a center of gravity 76 which is spaced perpendicularly from the striking face plane 22 by a distance $CG_1$ and is elevated above the ground plane 37 by a distance $CG_2$. According to one embodiment, $CG_1$ is preferably equal to approximately 1-5 mm, more preferably equal to approximately 2-4 mm, and still more preferably equal to approximately 2.2 mm, while $CG_2$ is preferably equal to approximately 10-25 mm, more preferably equal to approximately 15-20 mm, and still more preferably approximately 17.5 mm. Configuring the adjustable club head 10 in this regard enables such adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

Furthermore, FIG. 11 illustrates that in the virtual central vertical plane, the parting line 56 is spaced rearwardly from the leading edge 80 of the striking face by a horizontal distance, D5, and the sole surface comprises a sole surface horizontal length, D6. The distance D5 is preferably greater than or equal to approximately 0.35 inches, more preferably between approximately 0.40-0.70 inches, and most preferably equal to about 0.51 inches. The sole surface horizontal length D6 is preferably greater than or equal to approximately 0.50 inches, more preferably between approximately 0.70-1.00 inches, and most preferably equal to approximately 0.815 inches. According to one embodiment, the ratio of D5/D6 is greater than or equal to approximately 0.50, more preferably between approximately 0.55-0.70, even more preferably between approximately 0.60-0.65, and most preferably equal to approximately 0.63.

FIG. 11 further depicts a "take-off" angle, β, which is defined (in the virtual central vertical plane perpendicular to the striking face plan and passing through a ground contact point 82) as the angle between a line 78 (passing through the leading edge 80 and the ground contact point 82) and the ground plane 37. According to one embodiment, the take-off angle β is preferably equal to approximately 40-60°, more preferably equal to approximately 45-55°, and most preferably equal to approximately 51°.

The club head 10 preferably is of a head mass that is greater than or equal to approximately 200 g, more preferably between 240-300 g, even more preferably between 250-290 g, and most preferably equal to approximately 276 g. Furthermore, according to one embodiment, the moment of inertia through the center of gravity 76 about a vertical axis when the club head 10 is in the reference position is no less than approximately 3000 $g*cm^2$, more preferably no less than approximately 3400 $g*cm^2$, even more preferably between approximately 3500-3800 $g*cm^2$, and most preferably equal to approximately 3600 $g*cm^2$. By configuring the adjustable club head 10 in this regard, the feel of the club head may be more similar to a typical non-adjustable unitary club head, enabling such an adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

Figure 12:
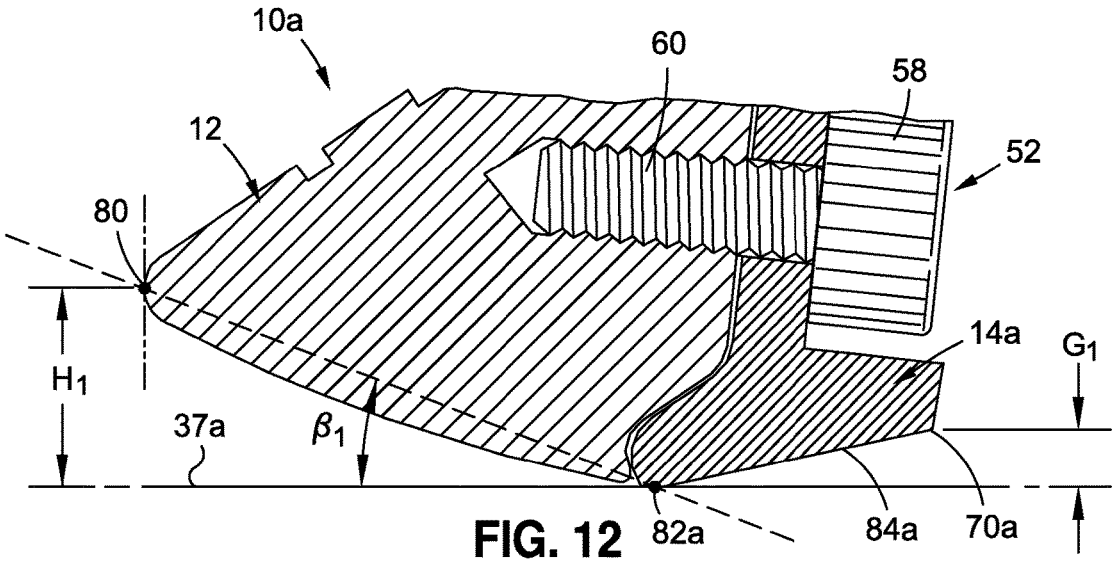
FIG. 12 is an enlarged, partial side sectional view of the club head having a first sole component coupled to the main body.
Figure 13:
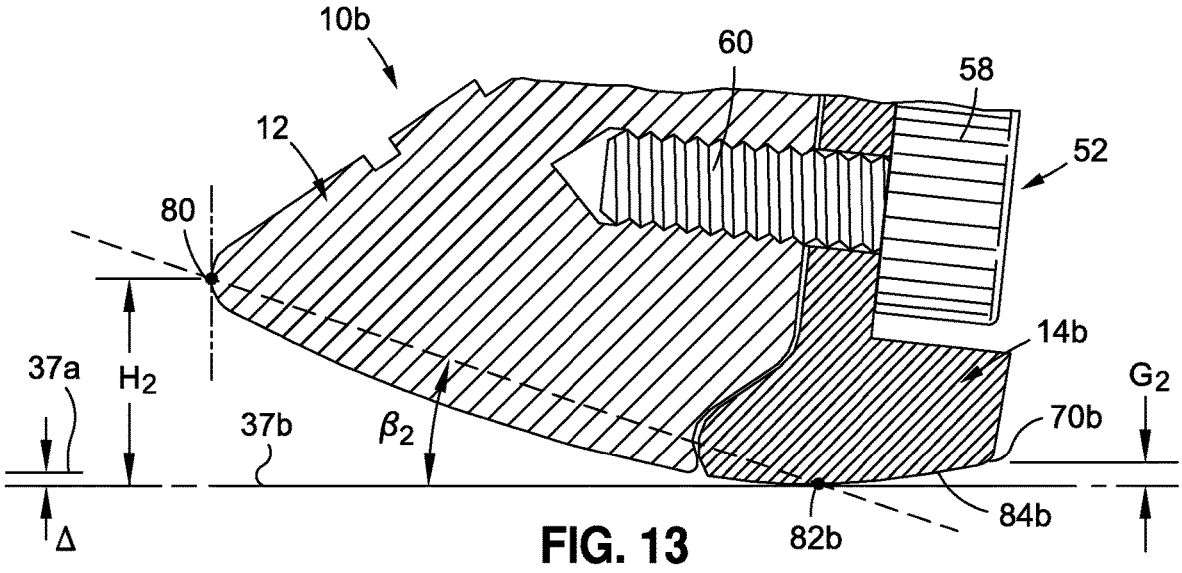
FIG. 13 is an enlarged, partial side sectional view of the club head having a second sole component coupled to the main body.
Figure 14:
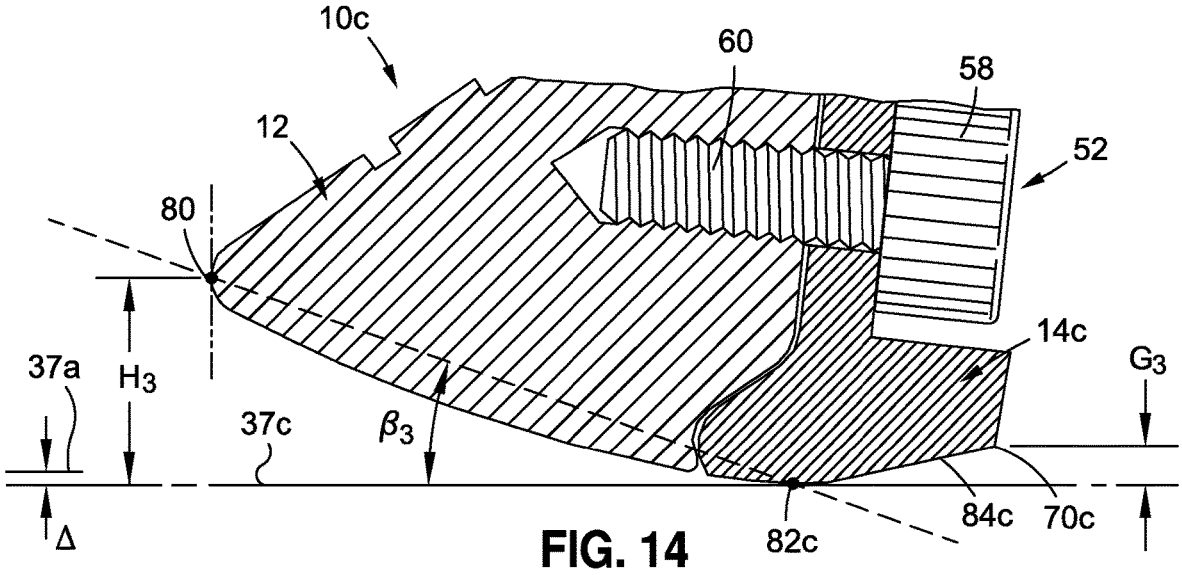
FIG. 14 is an enlarged, partial side sectional view of the club head having a third sole component coupled to the main body.

Referring now to FIGS. 12-14, there is depicted enlarged, partial, cross sectional views of three club heads 10*a*-10*c* formed with respective ones of three different, exemplary sole components 14*a*-14*c*. Referring first to FIG. 12, the first sole component 14*a* is coupled to the main body 12 to define the first club head 10*a*. The first sole component 14*a* defines a first ground contact point 82*a* where the first sole component 14*a* intersects with the ground plane 37*a*, which defines a first take-off angle, $\beta_1$, between the ground plane 37*a* and an axis passing through the first ground contact point 82*a* and the leading edge 80. The first ground contact point 82*a* and the leading edge 80 define a first leading edge height, $H_1$. The first sole component 14*a* further defines a first grind 84*a*, which extends rearwardly from the first ground contact point 82*a* and terminates at a first rearward-most point 70*a*, which is elevated above the ground plane 37*a* by a first grind height, $G_1$.

Referring now to FIG. 13, the second sole component 14*b* is coupled to the main body 12 to define the second club head 10*b*. The second sole component 14*b* defines a second ground contact point 82*b* where the second sole component 14*b* intersects with the ground plane 37*b*, which defines a second take-off angle, $\beta_2$, between the ground plane 37*b* and an axis passing through the second ground contact point 82*b* and the leading edge 80. The second ground contact point 82*b* and the leading edge 80 define a second leading edge height, $H_2$. The second sole component 14*b* further defines a second grind 84*b*, which extends rearwardly from the second ground contact point 82*b* and terminates at a second rearward-most point 70*b*, which is elevated above the ground plane 37*b* by a second grind height, $G_2$.

Referring now to FIG. 14, a third sole component 14*c* is coupled to the main body 12 to define a third club head 10*c*. The third sole component 14*c* defines a third ground contact point 82*c* where the third sole component 14*c* intersects with the ground plane 37*c*, which defines a third take-off angle, $\beta_3$, between the ground plane 37*c* and an axis passing through the third ground contact point 82*c* and the leading edge 80. The third ground contact point 82*c* and the leading edge 80 define a third leading edge height, $H_3$. The third sole component 14*c* further defines a third grind 84*c*, which extends rearwardly from the third ground contact point 82*c* and terminates at a third rearward-most point 70*c*, which is elevated above the ground plane 37*c* by a third grind height, $G_3$.

The first, second, and third sole components 14*a*-*c* each define respective contours, which modify the overall structural characteristics of the first, second, and third club heads 10*a*-*c*, with the aim being to provide different bounce characteristics for each club head 10*a*-*c*. in some cases, as shown a rear portion of the sole is ground to varying degrees. By increase the degree of grinding, the location of sole contact may vary, resulting in changes to take-off angle $\beta$ and leading edge height H. More specifically, for instance, according to one embodiment, the location of the first ground contact point 82*a* relative to the main body 12 differs from the location of the second and third ground contact points 82*b*, 82*c*, with the location of the first ground contact point 82*a* being located closer to the leading edge 80 than the location of the second and third ground contact points 82*b*, 82*c*. Furthermore, the leading edge height may vary from one club head to the next. For instance, the first leading edge height $H_1$ may be smaller than the second and third leading edge heights $H_2$ and $H_3$. According to various embodiments, the first leading edge height $H_1$ varies from the second and/or third leading edge heights $H_2$, $H_3$ by an amount $\Delta$, which is approximately equal to 0.15-0.40 mm, more preferably equal to approximately 0.20-0.25 mm, and most equal to approximately 0.218 mm. According to one embodiment, the first leading edge height $H_1$ is less than the second and/or third leading edge heights $H_2$, $H_3$ by the amount $\Delta$. Moreover, the grind heights, $G_{1\text{-}3}$, may vary between the sole components 14*a*-*c*, such that in one implementation, the first grind height $G_1$ is greater than the second grind height $G_2$ and the third grind height $G_3$. By configuring the adjustable club head 10 in this regard, the feel of the club head may be more similar to a typical non-adjustable unitary club head, enabling such an adjustable club head to be more likely accepted as a replacement for such a typical non-adjustable club head. As a corollary, by providing a more similar feel, such an adjustable club head 10, if used as a fitting tool, is more likely to feel like a conventional purchasable non-adjustable club head to which such adjustable club head 10 may have been intended to correspond. In this case, a golfer undergoing, e.g., a bounce fitting is less likely to be disappointed that an actual purchased club does not feel like a test club intended to represent the purchased club (or at a minimum feel that the fitting operation was of little value).

The various sole components 14*a*-*c* may provide certain benefits in different playing environments and/or for players having different swing characteristics. For instance, the first sole component 14*a* may be preferable when playing from firm conditions and tight lies. The first sole component 14*a* may also be more suitable for players with shallow attack angles. The second sole component 14*b* may be most accommodating for the largest variety of sand, turf and swing types. The third sole component 14*c* may be preferred when used on softer turf conditions and bunkers, or for use with players having a steep attack angle.

The ability to interchange the sole components 14*a*-*c* enables a user to easily test different feels, and thus, the sole components 14*a*-*c* effectively provide three club heads in one. A user may quickly move between different bounces with a single club by swapping one sole component 14 (e.g., sole components 14*a*, 14*b*, 14*c*) for another. Furthermore, it is easier to carry around several sole components 14 than it is to carry several different clubs, particularly around the course or on tour. The sole components 14 are also easier to manufacture at a lesser cost than entirely separate club heads. In addition, some golfers become accustomed to a particular striking face, which has been "worked" over a period of time, and thus, the golfer may be able to use different sole components 14 with the same striking face to achieve different bounce characteristics, rather than switching to an entirely different club.

It is contemplated that the various components described herein may be sold as a kit, wherein the main body 12 is sold with a plurality of sole components 14. The main body 12 may be sold in conjunction with a club shaft, or separate from a club shaft. It is further contemplated that the main body 12 and sole components 14 may be sold separate from each other.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An iron-type golf club head assembly kit comprising:

a main body including:

a striking face having a face center, a leading edge, and a virtual striking face plane;

a rear surface opposite the striking face; and a hosel defining a hosel axis; and a first sole component and a second sole component that are interchangeably associable with the main body, wherein:

when the first sole component is associated with the main body: (a) the main body and the first sole component form a first club head comprising a first leading edge comprising a first leading edge height and a first sole surface having a first parting line, formed between the first sole component and the main body, and a first sole contour; and (b) when the first club head is oriented in a reference position, in a virtual central vertical plane passing through the face center and perpendicular to the striking face plane, (i) in a direction perpendicular to the virtual striking face plane, the parting line is spaced rearwardly from the striking face by a distance D1 and the club head has a maximum depth D2 such that D1/D2 is no less than 0.40 and the first sole surface defines a first sole contact point, and (ii) the first sole component includes a first grind extending rearwardly from the first sole contact point and terminates at a first rearward-most point spaced from the first sole contact point to define a first grind height, G1; and when the second sole component is associated with the main body: (a) the main body and the second sole component form a second club head comprising a second leading edge comprising a second leading height that is greater than the first leading edge height and a second sole surface having a second parting line, formed between the second sole component and the main body, and a second sole contour that differs from the first sole contour; and (b) when the second club head is oriented in a reference position, in a virtual central vertical plane passing through the face center and perpendicular to the striking face plane, (i) in a front to rear direction, the second sole surface defines a second sole contact point that is rearwardly spaced from the second leading edge by a distance greater than the first sole contact point is rearwardly spaced from the first leading edge, and (ii) the second sole component includes a second grind extending rearwardly from the second sole contact point and terminates at a second rearward-most point spaced from the second sole contact point to define a second grind height, G2, that differs from the first grind height, G1.

2. The golf club head assembly kit of claim 1, wherein D1/D2 is no less than 0.50.

3. The golf club head assembly kit of claim 2, wherein D1/D2 is no less than 0.70.

4. The golf club head assembly kit of claim 1, further comprising a screw member having a screw head and a screw shaft that defines a screw shaft axis, wherein the screw member is configured to secure the first sole component to the main body to form the first club head such that, when the first club head is oriented in the reference position, the screw shaft axis intersects a virtual vertical hosel plane that contains the hosel axis at a screw shaft angle of between about 75° and about 110°.

5. The golf club head assembly kit of claim 1, wherein, when the main body and the first sole component are combined to form the first club head and when the first club head is oriented in the reference position, in the virtual central vertical plane and measured in the direction perpendicular to the virtual striking face plane:

(a) the first sole component further comprises a forward-most point defining a sole component forward plane parallel to the striking face plane and a rearward-most point defining a sole component rearward plane parallel to the striking face plane;

(b) a plane passing through the first parting line and parallel to the striking face plane is rearwardly spaced from the sole component forward plane by a distance D3; and (c) the sole component rearward plane is rearwardly spaced from the sole component forward plane by a distance D4 such that D3/D4 is no less than 0.30.

6. The golf club head assembly kit of claim 1, wherein when the main body and the first sole component are combined to form the first club head, and when the first club head is oriented in the reference position, in the virtual central vertical plane, the parting line is rearwardly spaced from the leading edge by a horizontal distance of no less than 0.35 in.

7. The golf club head assembly kit of claim 1, wherein when the main body and the first sole component are combined to form the first club head, the first club head further comprises a loft angle no less than 38°.

8. The golf club head assembly kit of claim 1, wherein the second leading edge height differs from the first leading edge height by at least 0.15 mm.

* * * * *